United States Patent [19]

Regan et al.

[11] Patent Number: 4,878,452

[45] Date of Patent: Nov. 7, 1989

[54] QUICK-RELEASE MOORING APPARATUS FOR FLOATING VESSELS

[75] Inventors: James B. Regan, Burnsville, Minn.; George J. Ikovich, Philadelphia, Pa.; James A. Carlsen, St. Paul, Minn.; Richard J. Juelich, Stillwater, Minn.; Henry G. Kogel, St. Paul, Minn.

[73] Assignee: Amca International Corporation, St. Paul, Minn.

[21] Appl. No.: 309,965

[22] Filed: Feb. 13, 1989

Related U.S. Application Data

[63] Continuation of Ser. No. 13,128, Feb. 10, 1987, abandoned.

[51] Int. Cl.[4] ..... B63B 21/50

[52] U.S. Cl. ..... 114/293; 175/423; 188/65.1; 188/67; 254/277

[58] Field of Search ..... 114/293, 179, 180, 181, 114/199, 200; 254/277; 266/165; 188/67, 65.1; 175/423

[56] References Cited

U.S. PATENT DOCUMENTS

| | | | |
|---|---|---|---|
| 2,695,096 | 11/1954 | Gridley | 226/165 |
| 2,823,792 | 2/1958 | Lord | 226/165 |
| 2,891,660 | 6/1959 | Honig . | |
| 3,031,997 | 5/1962 | Nesbitt . | |
| 3,096,075 | 7/1963 | Brown | 188/67 |
| 3,191,201 | 6/1965 | Richardson . | |
| 3,318,275 | 5/1967 | Field . | |
| 3,349,740 | 10/1967 | Field . | |
| 3,457,605 | 7/1969 | Kingsbury et al. | 188/67 |
| 3,563,043 | 2/1971 | Nelson . | |
| 3,643,765 | 2/1972 | Hanchen | 188/67 |
| 3,748,702 | 7/1973 | Brown | 188/67 |
| 3,803,942 | 4/1974 | Duggan . | |
| 3,842,776 | 10/1974 | Wudtke . | |
| 3,985,093 | 10/1976 | Eidem | 114/293 |
| 4,020,779 | 5/1977 | Kitt . | |
| 4,093,042 | 6/1978 | Pradon | 188/67 |
| 4,446,807 | 5/1984 | Johnson et al. | 254/277 |
| 4,448,393 | 5/1984 | Habegger et al. . | |
| 4,456,226 | 6/1984 | Stumpmeier . | |
| 4,476,801 | 10/1984 | Foster et al. | 114/293 |
| 4,593,884 | 6/1986 | Zschocke et al. . | |

OTHER PUBLICATIONS

"Recent Developments in Deep Water Mooring of Semi-Submersibles" by Christian V. Wolff, with attached FIG. 6 Mar. 9, 1984 letter from American Hoist & Derrick Co. to C. Wolff.

American Hoist & Derrick Co. Drawing P-10034.

*Primary Examiner*—Sherman D. Basinger
*Assistant Examiner*—Thomas J. Brahan
*Attorney, Agent, or Firm*—Dorsey & Whitney

[57] ABSTRACT

The present invention is an improved platform-mounted apparatus for holding and rapidly releasing a flexible load line having the properties of a wire rope. The invention comprises wedge gripper means for holding the line up to a tensile force substantially equal to the breaking strength of the line, with the gripper means comprising a grip frame for mounting to the platform and a pair of opposed grip wedges, the wedges having opposed internal gripping surfaces for engaging the line and external wedging surfaces that taper toward each other in the direction of the tensile force in a gripped line, each grip wedge having a wide end and a narrow end. Grip connection means connect the wide end of each grip wedge to the grip frame, said grip connection means defining a lower travel limit for each grip wedge in the direction of the tensile force in a gripped line. A grip body has opposed seating surfaces against which the external wedging surfaces of the grip wedges moveably bear, said seating surfaces tapering toward each other at substantially the same angle as the external wedging surfaces, such that motion of the grip wedges into the taper of the seating surfaces causes the opposed grip wedges to wedge together to engage the line and motion out of the taper of the seating surfaces causes release of the line. Release means connected to the pair of grip wedges and the grip body positively move the grip body relative to the grip wedges to cause line release. When the wedge gripper means is combined with a winch means for mounting to a platform, with the winch means having the ability to draw in and hold the line up to a tensile force less than the breaking strength of the line, the combined apparatus can draw in, hold, pay out and rapidly release a mooring line.

24 Claims, 6 Drawing Sheets

QUICK-RELEASE MOORING APPARATUS FOR FLOATING VESSELS

This application is a continuation of application Ser. No. 07/013,128, filed Feb. 10, 1987, now abandoned.

BACKGROUND OF THE INVENTION

1. Field of the Invention

This invention has relation to the mooring of floating vessels over predetermined locations on the floors of bodies of water. More specifically, it relates to the holding and rapid release of wire rope mooring lines, as well as the rapid paying out and drawing in of extensive lengths of wire rope mooring lines under varying loads.

2. Description of the Prior Art

It is known to anchor semi-submersible offshore drilling platforms in place utilizing elongated anchor lines extending out from such platforms in several directions. See U.S. Pat Nos. 3,842,776, 3,318,275 and 3,349,740. Semi-submersible oil exploration and drilling platforms include large horizontal floats or pontoons that are kept entirely air-filled while they are being towed into place to cause the platforms to float on the surface of the water. In order to minimize the effects of ocean swells and waves on the platforms during use of the platforms for their intended purposes, the pontoons are filled with water and submerged. This subjects only the narrow main vertical support columns to the surface action of the sea.

Relatively high tensile forces in the mooring lines are necessary for stable mooring. Once a platform is in its desired position, the sea water can be let into the pontoons to achieve the desired submersion of the platform. Winches can be used to draw in the lines at whatever force the winches can deliver. Then, in the process of fixedly mooring the platform, the water can be evacuated from the pontoons, leaving the mooring lines passing through fairleads located at lower portions of the platform to restrain the platform from rising as the pontoons become more and more buoyant. This has the effect of positively and firmly fixing the positioning of the platform over a drilling point, for example, and substantially diminishes the effects of surface action of the seas on the platform. After and as the pontoons are evacuated, extreme upward forces are being absorbed by the mooring lines.

In floating offshore drilling platforms and in similar vessels, deck space and other working space are at a premium. The economic effectiveness of a particular vessel is measured in proportion to the amount of space available to perform the primary function of the vessel (drilling for oil, for example) and in reverse proportion to the amount of space required for the necessary subsidiary functions (holding the vessel in place and handling and storing the mooring lines, for example). Also important is the weight of deck-located mooring equipment, because the vessel may have limited structural or carrying capacity, most of which must be dedicated to its primary functions.

In the past, mooring lines have been handled primarily on large winch-driven single drums. Such a drum must often carry extensive lengths of the line it holds. It must also be able to pull with sufficient force to draw up a mooring line to the desired tension, often several hundred thousand pounds of force. The same line-carrying drum, equipped with a braking system, is usually also required to provide the braking or holding force after the desired mooring tension is achieved.

Good design and recent safety regulations in some jurisdictions have added a new requirement for mooring systems, namely, the ability to quickly release and pay out the moored line in certain emergency situations. For example, when there is a release of gas below the surface, the buoyancy of the platform is reduced by all the gas dissolved in the surrounding water. This reduced buoyancy can cause the platform to sink rapidly. One solution is the rapid release of one or more mooring lines on one side of the platform, so that the mooring forces in the remaining lines can quickly pull the platform away from its moored position.

When a single winch-driven drum is used, the larger the drum, the more difficult it is for the drum to provide the necessary pulling and holding forces under conditions where a great deal of line is carried on the drum. As the distance of the outer wrap of the line relative to the drum axis increases, the torque necessary to place a given tensile force in the line increases. As greater tensile forces are exerted, there is an increased tendency of the last wrap of the line to force itself in between the inner wraps of the line, causing irregular winding of the line. The preceding problems would become particularly acute if safety design requirements were to demand that a winch-driven drum hold or pull forces approaching the breaking strength of the mooring lines. Usually, the breaking strength is significantly greater than the typical forces pulled by the winch when a mooring line and anchor are set. These problems are also acute when a vessel made for deep-water mooring is moved to shallower water, where a large portion of each mooring line is not paid out and must be stored in wraps on each winch. This large load of line severely reduces the winch's ability to pull and hold high mooring forces, because the winch is always pulling at a relatively large distance from it drum axis.

While winch-driven drums and their brakes and power units can be made larger and more powerful to deliver the required pulling and holding forces, they become increasingly expensive and heavy and take up more and more valuable deck space and carrying capacity. Their size and inertia also make quick release mechanisms for the drums difficult to design. Also, in retrofit situations, increasing the size of winches and related units may be limited by pre-existing design constraints.

Retrofitting mooring systems to increase mooring capacity is not uncommon. Improvements in wire rope design have permitted wire rope of a given size to have up to 40 percent greater breaking strength. But more powerful (and larger) winches are usually necessary to take advantage of this added strength. Increased safety requirements or design limitations on vessel excursion in storm situations may also make it desirable to upgrade mooring systems on existing vessels. Again, retrofitting with larger and more powerful conventional winch equipment offers one solution but leads to the problems discussed. Additional lines can also upgrade mooring capability, but these, too, use up deck space and carrying capacity.

One alternative to winch-driven drums is a linear pulling machine, such as that sold under the trademark "Lucker" by American Hoist & Derrick Company, Marine/Energy Division, St. Paul, Minn. Such machines use two Lucker wedge grip assemblies, one of which can be reciprocated relative to the other to pull successive short lengths of line with high forces. But these machines, while capable of pulling high forces and holding to the breaking strength of a line, are not suited for rapid pulling. Also, because their holding force on a line depends, in part, on tesion in the line, they pose special problems for rapid release. In particular, a Lucker grip, when holding a line under tension, must have all or substantially all of that tension removed before the grip wedges can be released.

U.S. Pat. No. 4,446,807 shows a mooring system using both a winch-driven drum and a Lucker pulling machine. The former is used for all line handling and pulling, except pulling involving the highest line tension, where the latter is employed.

The grip wedges of the Lucker machine in U.S. Pat. No. 4,446,807 can not only be used in line pulling but can also provide line holding. This is advantageous, because when a Lucker grip holds the line, the load is taken off other components. With a Lucker grip located above the fairlead, the winch and its brake and bearings are relieved of load, saving wear and tear and facilitating inspection, adjustment and repair. In some installations, it would even be possible to move a winch to another position or use it for another purpose while the Lucker grip holds the line. But use of a Lucker grip to hold a mooring line poses a dilemma, because a Lucker grip is capable of holding forces greater than those drveloped by either the winch-driven drum or the pulling section of the linear pulling machine in a mooring system such as in U.S. Pat. No. 4,446,807. If a Lucker grip is on a line and the line tension increases, due to a storm or raising of the platform by change in buoyancy, so that line tension exceeds the pulling capability of the winch-driven drum and the pull section of the Lucker machine, then the line cannot be released until tension decreases (except by cutting, in which case the mooring is irretrievably lost). U.S. Pat. No. 4,446,807 provides no mechanism for releasing a Lucker grip when tension of the line in the grip cannot be relieved.

Even in situations where a winch-driven drum or the pulling section of a linear pulling machine can pull with enough force to relieve the tension on a line held by a Lucker grip, readying the equipment to deliver this force may take time. In an emergency, quick release of the line is highly desirable.

A solution that has been proposed is an over-center trip mechanism that permits a Lucker grip in a linear pulling machine to move a short distance in the direction of the mooring lines's pull to come into contact with a pair of projections that prevent motion of the grip wedges holding the line. Although the grip wedges are stopped, the body of the Lucker grip will continue to travel a brief distance beyond the stopping point of the grip wedges. Due to the grip wedges' construction, this relative motion between the grip wedges and the grip body causes the grip wedges to release the line. A serious drawback of this design is that it relies on momentum of the grip body to separate the grip body and the grip wedges. This momentum may not be reliable and will be less effective in horizontal positions of a Lucker grip, where gravity will not help accelerate the grip body. If friction or some other obstructive force intervenes, there is no positive action to separate the grip body and its grip wedges to causes line release.

What is needed in the prior art is mooring apparatus that permits positive and quick release of mooring lines, that can deliver required pulling forces and pull at high speeds and that permits holding to the breaking strength of a line.

SUMMARY OF THE INVENTION

The present invention is an improved platform-mounted apparatus for holding and rapidly releasing a flexible load line having the properties of a wire rope. The invention comprises wedge gripper means for holding the line up to a tensile force substantially equal to the breaking strength of the line, with the gripper means comprising a grip frame for mounting to the platform and a pair of opposed grip wedges, the wedges having opposed internal gripping surfaces for engaging the line and external wedging surfaces that taper toward each other in the direction of the tensile force in a gripped line, each grip wedge having a wide end and a narrow end. Grip connection means connects the wide end of each grip wedge to the grip frame, said grip connection means defining a lower travel limit for each grip wedge in the direction of the tensile force in a gripped line. A grip body has opposed seating surfaces against which the external wedging surfaces of the grip wedges movably bear, said seating surfaces tapering toward each other at substantially the same angle as the external wedging surfaces, such that motion of the grip wedges into the taper of the seating surfaces causes the opposed grip wedges to wedge together to engage the line and motion out of the taper of the seating surfaces causes release of the line. Release means connected to the pair of grip wedges and the grip body positively move the grip body relative to the grip wedges to cause line release. When the wedge gripper means is combined with a winch means for mounting to a platform, with the winch means having the ability to draw in and hold the line up to a tensile force less than the breaking strength of the line, the combined apparatus can draw in, hold, pay out and rapidly release a mooring line.

It is an objective of the invention to provide an apparatus for drawing in, holding, paying out and rapidly releasing a flexible load line having the properties of a wire rope, where the apparatus holds to the breaking strength of the line.

It is another objective of the invention to provide an apparatus for drawing in, holding, and paying out a flexible load line that has a tapered wedge grip assembly with means for positive, rapid release of the grip wedges.

It is further objective of the invention to provide an apparatus for drawing in, holding and paying out a flexible load line that utilizes a traction or other winch to draw in the line up to a line tension les than the breaking strength of the line and a tapered wedge grip assembly to releasably hold the line up to the breaking strength of the line.

It is an additional objective of the invention to provide a mooring system that can be used as original equipment or built as a retrofit, in which a tapered wedge grip assmbly is used to hold loads greater than those introduced by associated winch means and to relieve the associated winch means of the wear and tear placed on it by a mooring line.

These and other objectives will become more apparent in the following detailed description of the invention and by reference to the attached drawings.

BRIEF DESCTIPTION OF THE DRAWING

Figure 7A:
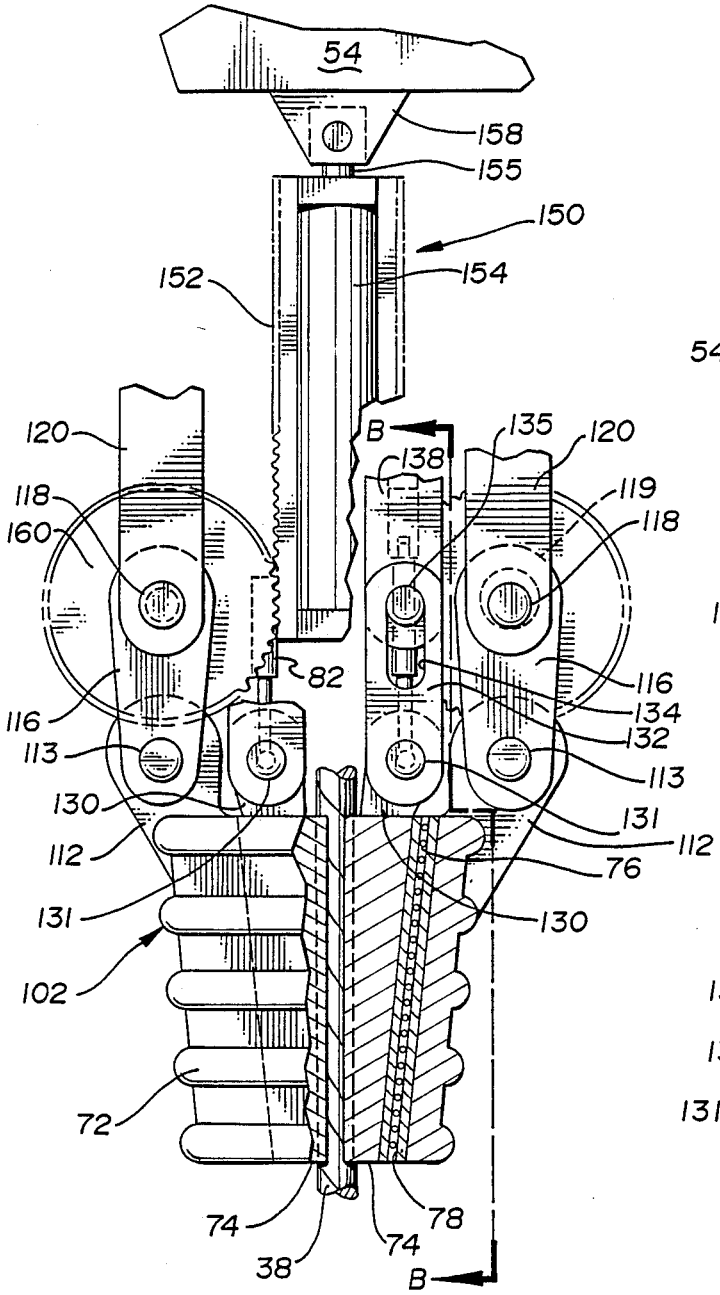

FIG. 7*a* is a detail elevational view showing a portion of the quick release mechanism on the tapered wedge grip assembly of the present invention, with wedge activation cylinders and other parts removed for clarity of illustration.

Figure 7B:
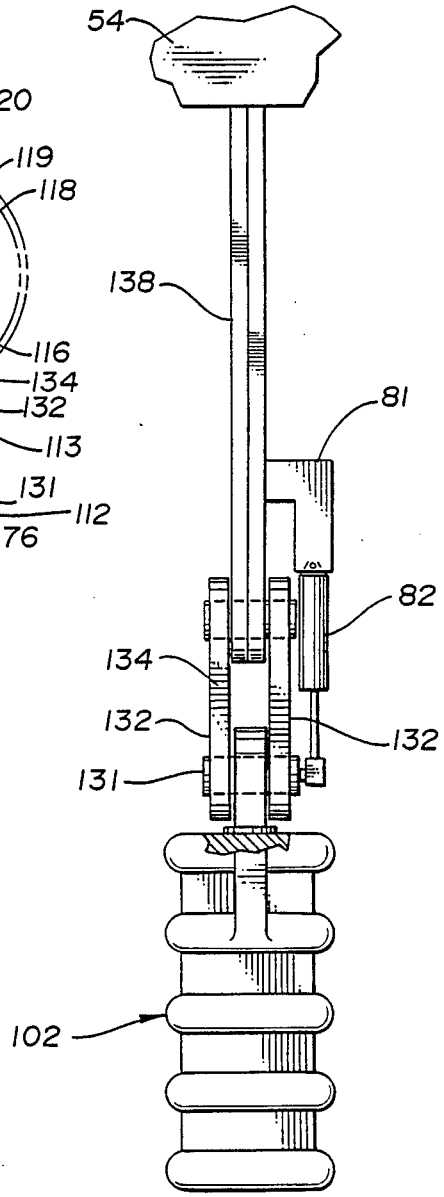

FIG. 7*b* is a side view of the tapered wedge grip assembly as shown in FIG. 7*a* taken along line B—B of FIG. 7*a*, with additional parts removed for clarity of illustration.

Figure 8:
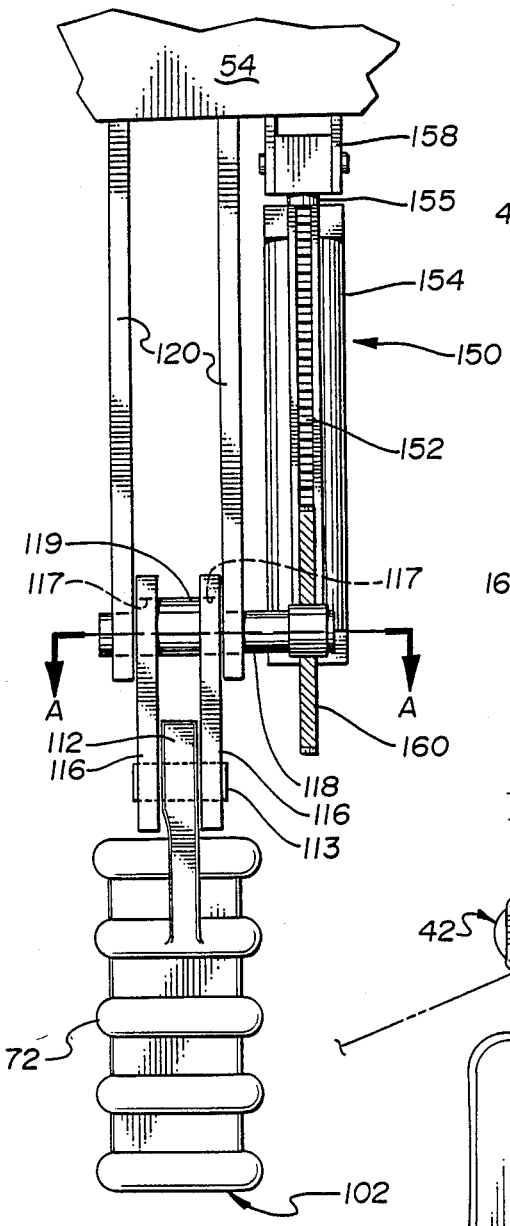

FIG. 8 is a side view of the tapered wedge grip assembly as shown in FIG. 7*a*, with additional parts removed for clarity of illustration.

Figure 9:
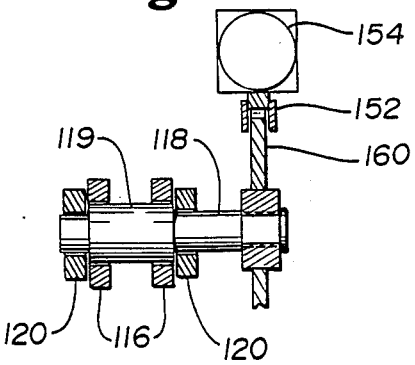

FIG. 9 is a sectional view taken along line A—A of FIG. 8.

Figure 10:
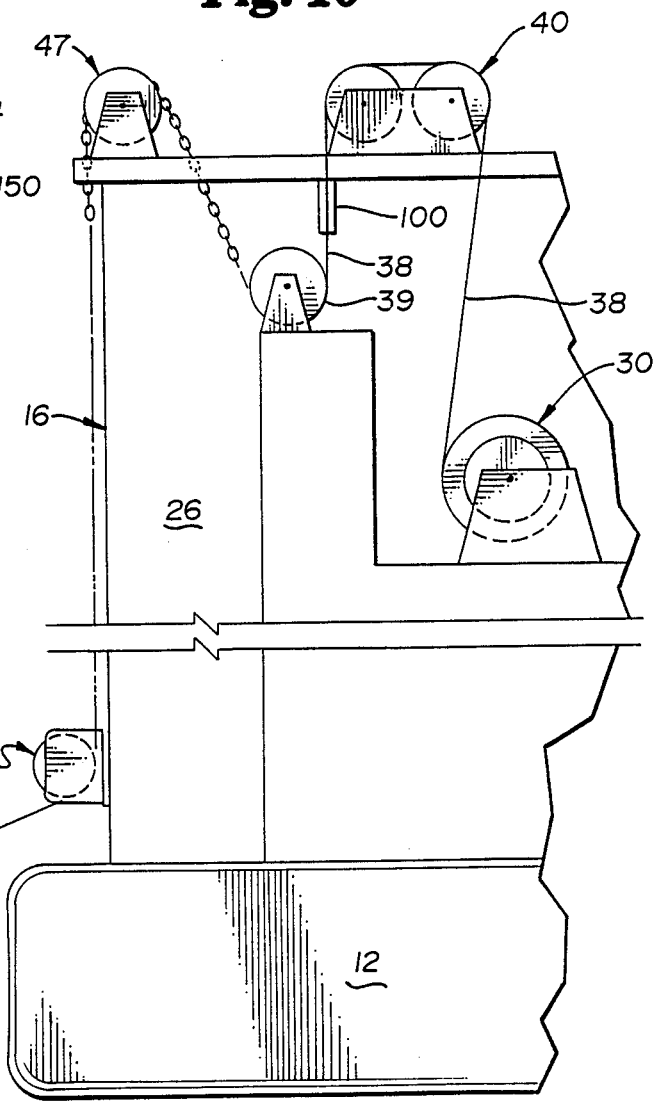

FIG. 10 is a schematic drawing of a variation of the present invention in which a portion of the mooring line is chain rather than wire rope.

DETAILED DESCRIPTION OF THE PREFERRED EMBODIMENT

Figure 1:
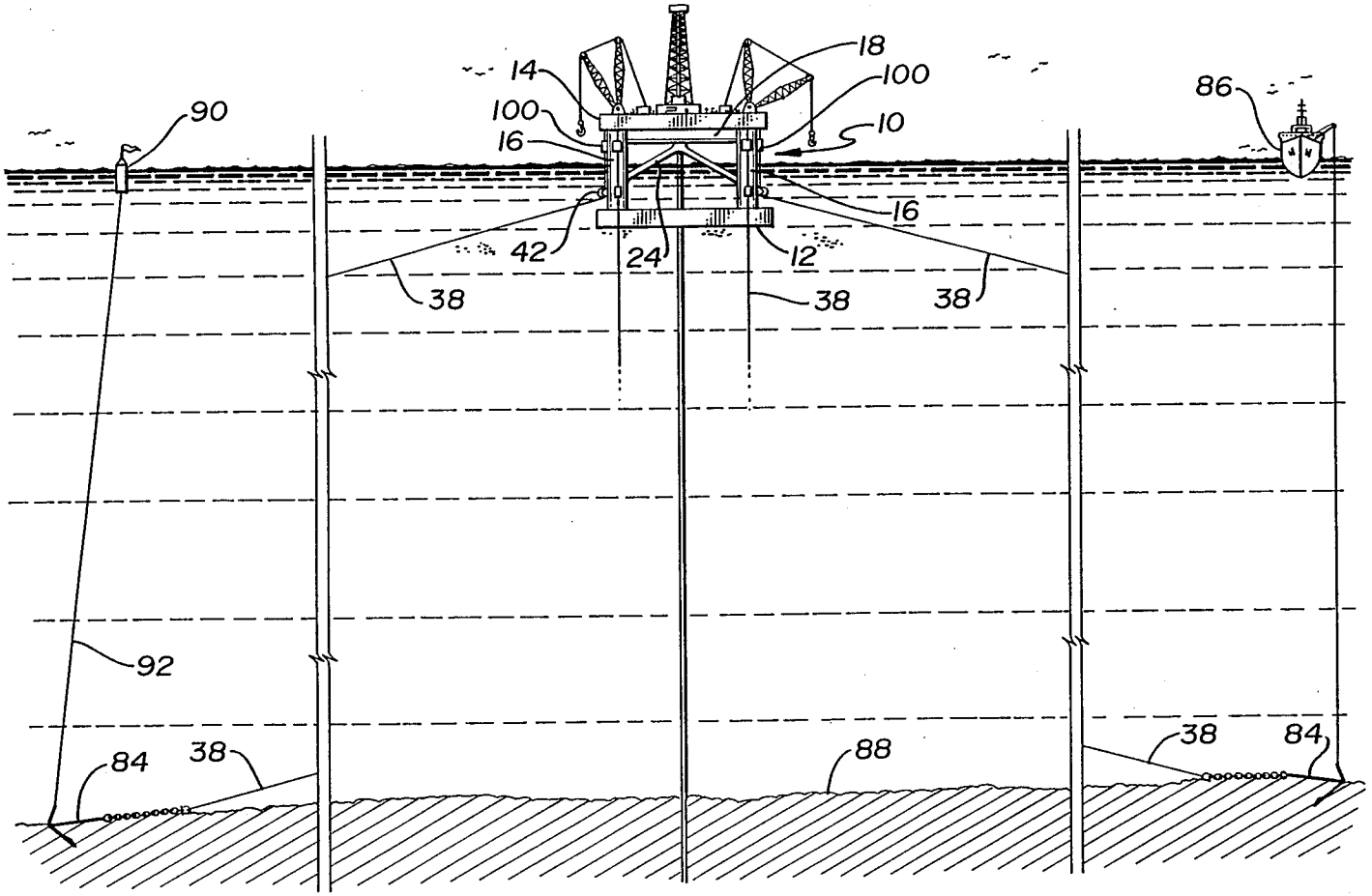
FIG. 1 is an elevational view of a semi-submersible offshore oil exploration and drilling platform employing the mooring apparatus of the present invention.
Figure 2:
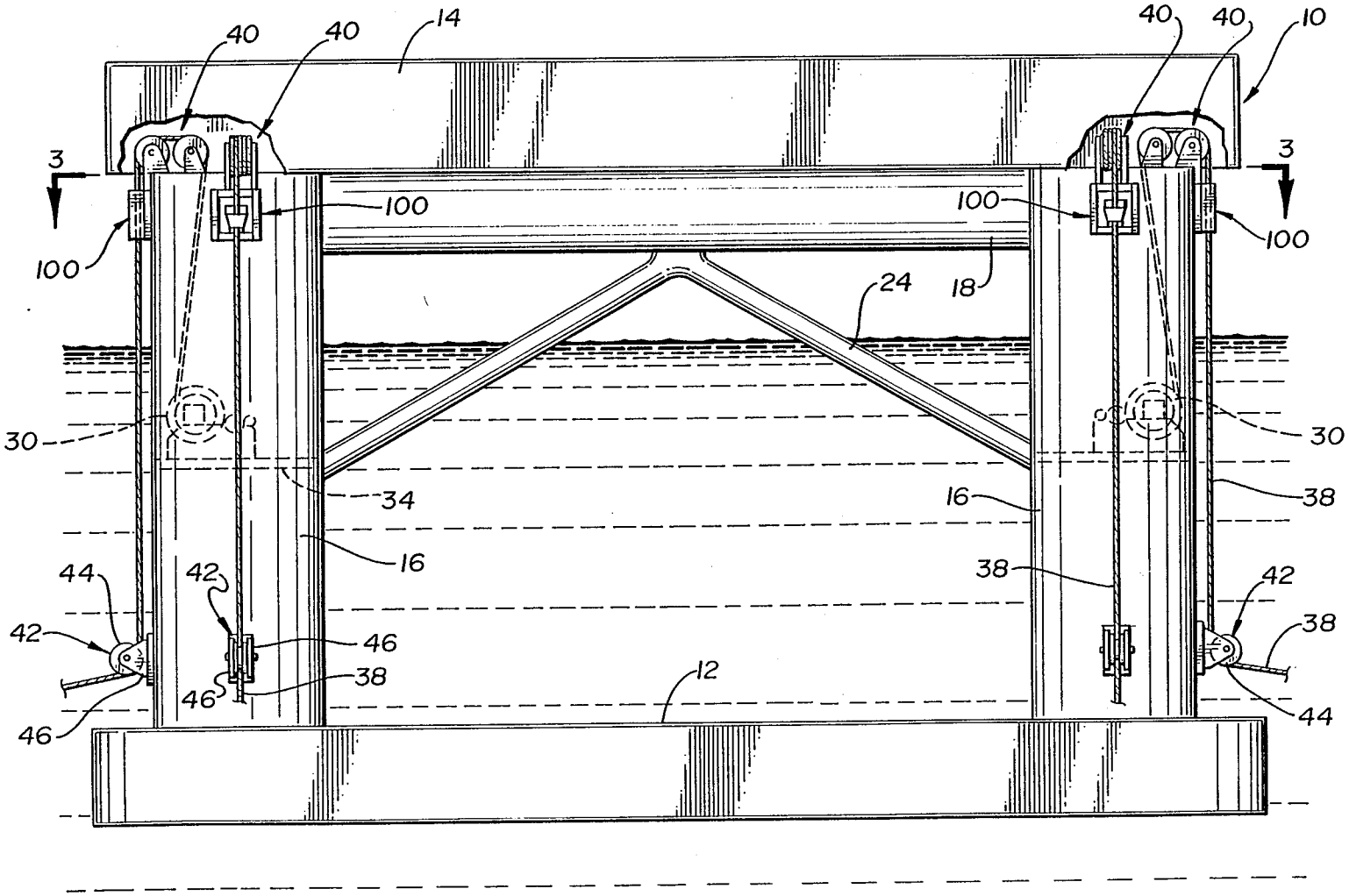
FIG. 2 is an enlarged elevational view of the platform and some of the apparatus of FIG. 1.
Figure 3:
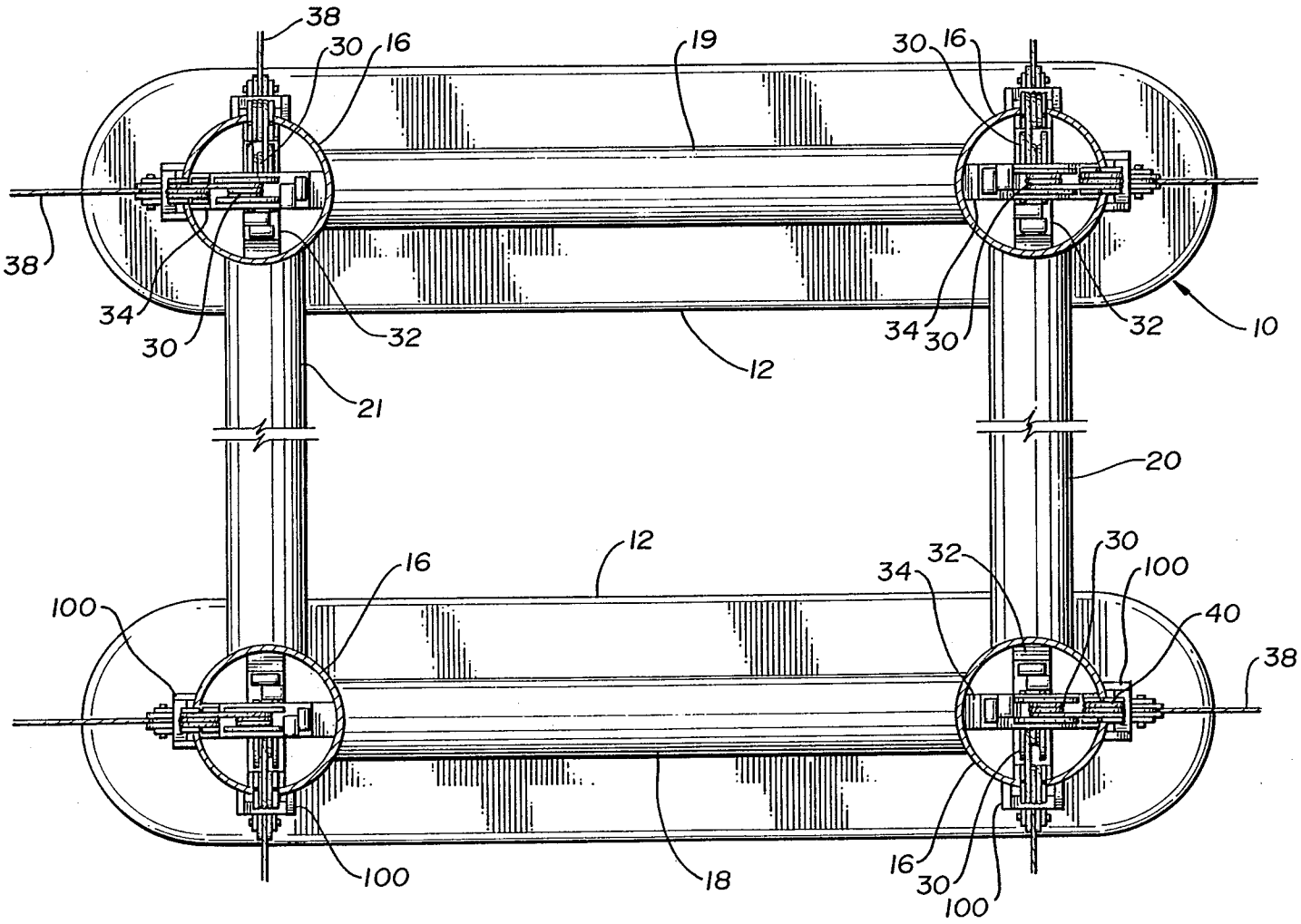
FIG. 3 is a top plan view of the platform and apparatus of FIGS. 1 and 2 taken on the line 3—3 in FIG. 2, with parts omitted for clarity of illustration.

A semi-submersible oil exploration and drilling platform or vessel 10 is shown in FIGS. 1 through 3 as including a pair of horizontal pontoons 12, 12 supporting a deck 14 on four main vertical cylindrical hollow support columns 16. Horizontal support braces 18, 19, 20 and 21 extend between adjacent support columns 16 and underlie the deck 14 to provide support for the deck. Diagonal braces 24 between the horizontal braces and the vertical support columns add further rigidity.

The pontoons 12 can be selectively opened to sea water or can be pumped dry in any usual or preferred manner (using equipment not shown), depending on whether it is desired to initially have the platform or vessel 10 float with the pontoons submerged or float on the surface of the supporting body of water. The platform 10 is also provided with a source of electrical energy (not shown) of any usual or preferred type. All of the structure described to this point is well known in the prior art and forms no part of the present invention per se.

Figure 6:
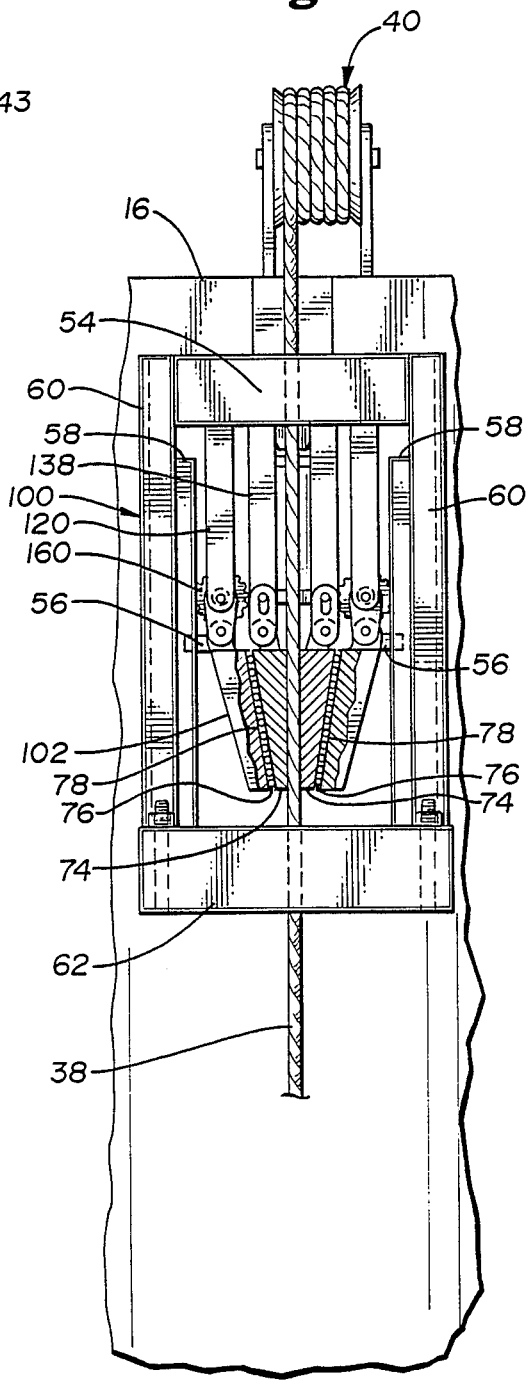
FIG. 6 is an enlarged fragmentary elevational view of a portion of the vertical support column of FIGS. 4 and 5 as seen from the right in FIG. 5 with the grip lid of the tapered wedge grip assembly removed for purposes of illustration.

In the form of the invention shown, the power source for operating the apparatus of the invention includes a power unit 26 associated with the top of each of the support columns 16 (FIG. 6). The details of these power units are not shown, as these units could take many forms in providing the necessary hydraulic fluid and air under pressure to operate the illustrated apparatus of the invention. Motors and hydraulic pumps could be provided in each of the four power units 26.

While many configurations of mooring lines are possible, using various numbers of lines, by way of example the invention will be explained in terms of a mooring system with eight lines. In this system, eight separate single drum storage winches 30 are provided to aid the eight corresponding traction winches 40 with which the storage winches 30 are associated and for accumulation of line handled by the mooring system. Two such storage winches 30 are mounted inside of each of the hollow vertical support columns 16. As best seen in FIGS. 2 and 3, one of each pair of winches 30 is mounted on a lower transversely extending winch support frame 32, while the other winch of the pair is mounted at right angles to the first winch on an upper transversely extending winch support frame 34. Each winch 30 includes braking means, such as an external band type brake 36 (FIG. 5), preferably one which is spring set and power released as in the form of the invention shown. As the winching force requirements for the storage winches 30 are a small proportion of the force requirements for the traction winches discussed below (only a small amount of back-tension needs to be applied), many different power operated winches would be satisfactory for this purpose. An American Hoist & Derrick Company Anchor Hoist with drum grooved to receive 3-¾ inch (9.6 cm) diameter wire rope and having a capability of operating at high speed/low torque and of operating at low speed/high torque is an example of typical satisfactory equipment.

Figure 4:
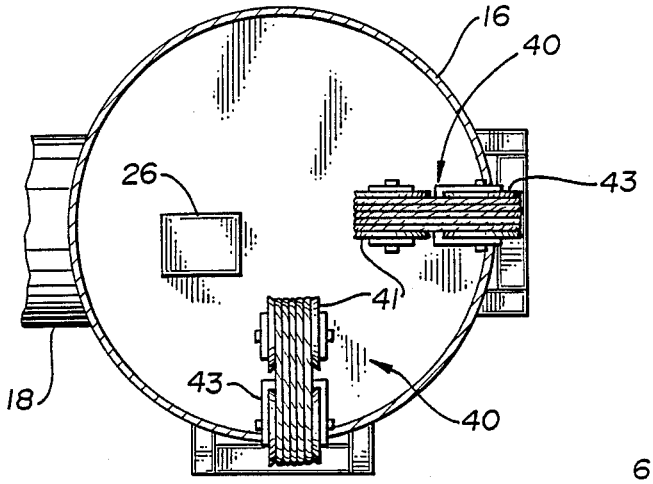
FIG. 4 is an enlarged fragmentary top plan view of one of the four main vertical support columns.
Figure 5:
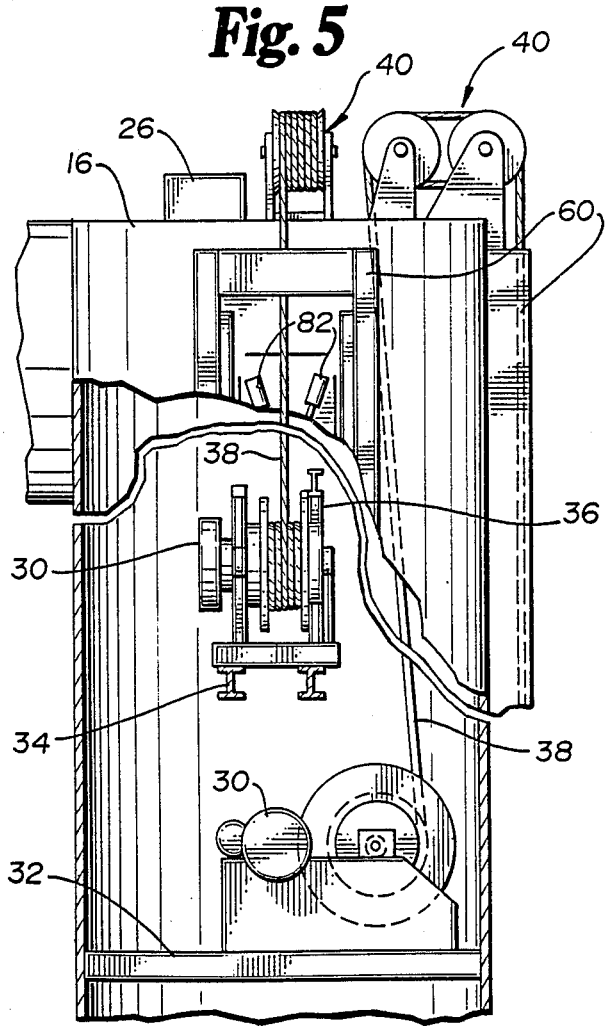
FIG. 5 is a fragmentary elevational view of an upper portion of the vertical support column of FIG. 4 with parts in section and parts broken away.

A flexible mooring line such as wire rope 38 includes an inner end portion which is fastened to and wound on the drum of each storage winch 30. This line 38 extends up out of the top of its support column 16 to a twin drum traction winch 40, as shown in FIGS. 2, 4–5, with drums 41, 43 driven by a single pinion gear (not shown). (These winches permit maximum advantage to be obtained from the inventive apparatus. However, the traction winches 40 could also be replaced with single drum winches mounted in the same position or with single drum winches replacing the storage winches 30 and used with a head sheave placed drum 43 is located or with a linear pulling machine.) The line 38 is wrapped three or more times (preferably five to seven times) around the linked pair of drums 41, 43 forming each traction winch 40. The outermost drum 43 of the linked pair is mounted at the outer edge of its respective support column 16 so that the line 38 can be led down the outside of the column 16 toward other elements of the mooring apparatus.

At a lower portion of each vertical support column 16, a fairleader or fairlead means 42 is mounted below each traction winch 40 in position so that mooring line 38 being carried by traction winch 40 will run essentially vertically down from that traction winch 40 and onto the fairleader or fairlead means 42 where it will be encompassed and guided by that faileader. The fairleader 42 includes a sheave 44 that is rotatably mounted on a horizontal axis with respect to side plates 46, 46 of the fairleader. These side plates 46, 46 are pivotally mounted on a vertical axis with respect to a lower portion of the support column 16.

Mounted on the outside vertical cylindrical wall of each main support column 16 is a pair of tapered wedge grip assemblies 100, placed at a 90 degree angle to each other and each in encompassing relationship with respect to one of the flexible mooring lines 38. As best seen in FIG. 6, each wedge grip assembly 100 is mounted on grip frame including an upper cross head 54 and parallel side beams 60 joined to a lower crosshead 62. A pair of grip guide tabs 56, 56 extend outwardly from the grip body 102 to slide with respect to guide tracks 58, 58 which are fixedly mounted to the inside of side beams 60 on the outer surface of the support column 16. Each wedge grip assembly 100 includes grip body 102 and a grip lid 72. The grip assembly 100 is depicted in FIG. 6 without the grip lid 72 in order to more clearly illustrate the operation of the wedge grip assembly 100. As most clearly seen in FIGS. 6 and *7a*, each wedge grip assembly 100 includes tapered grip wedges 74, 74 having gripping surfaces appropriately grooved to received and act on the flexible mooring line 38. The wedge grip assembly 100 is symmetrical about the center line of the line 38. Roller bearings 76 support the outer tapered wedging surfaces of these wedges 74, 74 on tapered opposed seating surfaces 78, 78 which form an integral part of the grip body 102. Tracks (not shown) in the grip lid 72 or grip body 102 cause the grip wedges 74, 74 to stay in contact with bearings 76.

Referring now also to FIGS. *7b* and 8, each wedge grip assembly 100 has a pair of hydraulic cylinders 82, 82 for wedge actuation. (For drawing simplicity, only one of the pair is shown in FIGS. *7a* and *7b*.) The rod of each of these ccylinders 82 is connected to one of the grip wedges 74, 74 at an ear 130. The other end of each cylinder 82 is connected via L-shaped bracket 81 to a wedge support 138, that, in turn, is connected to crosshead 54. When the cylinders 82 of a particular wedge grip assembly 100 are both activated to move the rods into the cylinders 82, the grip wedges 74, 74 of that wedge grip assembly 100 will be moved upwardly with respect to grip body 102 and out of the taper of the opposed seating surfaces 78, thus moving that wedge grip assembly 100 effectively into clearing or releasing relationship with respect to its mooring line 38.

When the cylinders 82 of a wedge grip assembly 100 are activated to extend their rods outwardly and downwardly from their cylinder bodies, the grip wedges 74, 74, acting under the influence of tapered seating surfaces 78 and roller bearings 76 (only partially shown in FIG. *7a*), are brought into contacting and positive gripping relationship with respect to the wire rope flexible mooring line 38.

As discussed above and as may be seen from the wedge construction of grip assembly 100, once the grip wedges 74, 74 contact a line 38 under tension, they are drawn by rope friction into the taper of the seating surfaces 78, causing the grip squeeze on line 38 to become tighter. This geometry, combined with the strength of the materials from which the wedge grip assembly 100 is made, permits it to hold to the breaking strength of the line 38. Conversely, release of the line 38 from the gripper jaws 74, 74 normally requires that the tension in line 38 be relieved; otherwise, the grip wedges 74, 74 cannot be withdrawn (because of friction) from their wedged position against the line 38, a situation sometimes called self-locking.

in the present invention a positive release mechanism is associated with the wedge grip assembly 100 that permits the grip body 102 with the seating surfaces 78 to be moved relative to the grip wedges 74, 74 between a grip position and a release position. In particular, the grip body 102, when in its grip position, is moved a short distance from that position in the direction of the mooring line tensile force while the grip wedges 74, 74 are held stationary (or move a lesser distance), such that the tightly wedged position of the grip wedges 74, 74 is relieved. After the wedged position of the grip wedges 74, 74 is relieved, the grip body 102 is in its release position. This position releases the line 38 to run out until tension is relieved or until the release mechanism is reversed to bring the grip body 102 back to its grip position, where the grip wedges 74, 74 can again be brought into tight wedging relationship with the seating surfaces 78 and the line 38 by cylinders 82.

As best seen in FIGS. *7a*, *7a*, *7b* and 8, the grip body 102 has a pair of ears 112 at its upper corners. To each ear 112 is connected (in FIG. 8 this construction is shown as a side view for only the right ear (as seen in FIG. *7a*), but it is present on both) a pair of release links 116, one on the front and one on the back side of each ear 112. The lower end of the pair of release links 116, 116 is connected to the ear 112 by a pin 113. Each upper end of each pair of release links 116 is connected to a cam 119 on a cam shaft 118. In particular, the circular opening 117 in each of the pair of release links 116, 116 receives one end of a cam 119 of circular cross-section. Each cam 119 is mounted off-center in the same fashion on its cam shaft 118, which is received in the opening at the lower end of a pair of cam shaft supports 120 connected to crosshead 54. As can be seen, when the cam shaft 118 and cam 119 are in the position shown in the right side of FIG. *7a*, each release link 116 is raised so that the center of the opening 11 is above the center axis of the cam shaft 11. After the cam shaft 118 is rotated 180 degrees from this position, the center of the opening 117 is below the center axis of the cam shaft 118. This 180 degree rotation thus moves the grip body 102 a distance equal to twice the maximum distance between the center of cam 119 and the center of cam shaft 118. The release links 116 connected to the ears 112 and connected via the cam 119 and cam shaft 118 t cam shaft supports 120 serve as grip body holding means for connecting the grip body 102 to the grip frame at crosshead 54.

Referring still to FIGS. *7a*, *7b* and 8, it will be seen that each of grip wedges 74, 74 has a connection ear 130 at its upper end. To each connection ear 130 is connected a pair of wedge links 132, one on the front and one on the back side of each ear 130. The lower end of the pair of wedge links 132 is connected to the ear 130 by a pin 131. As best seen in FIG. *7b*, this pin 131 also serves as a connection point for the rod of wedge actuation cylinder 82. Each upper end of the pair of wedge links 132 has a slot 134 in it, in which a connection pin 135 resides. The connection pin 135 extends in either direction from a wedge support 138 connected to crosshead 54. (The base of cylinder 82 is connected to wedge support 138 by L-shaped connection bracket 81.) As can be seen, the slots 134 permit the grip wedges 74, 74 to be drawn upward in the direction of the crosshead 54 by cylinders 82. Downward travel of the grip wedges 74, 74 is limited by the length of the slots 134. The wedge links 132 connected to the ears 130 and connected via pin 135 to wedge support 138 serve as grip wedge connection means for connecting the grip wedges 74 to the grip frame at the crosshead 54.

Referring now to FIGS. *7a*, 8 and 3, the release actuator assembly 150 that utilizes the previously described structure grip body holding means and grip wedge connection means for connecting the grip body 102 and the grip wedges 74, 74 to the crosshead 54 will be explained. As noted above, rotation of the cam shafts 118 drives the grip body 102 away from or toward the crosshear 54. Rotating the cam shafts 118 is accomplished in a release actuator assembly 150 that includes a toothed rack 152 mounted on a hydaulic cylinder 154, the rod 155 of which is connected to cylinder support 158 on crosshead 54. The rack 152 has teeth on both sides, which engage and mesh with teeth on the circumference of a pair of release gears 160. Each release gear 160 is rigidly attached to the extended portion of one of the cam shafts 118 that passes through cam shaft supports 120. Downward travel (as seen in FIGS. 7*a* and 8) of the rack 152 driven by the cylinder 154 causes the release gears 160, 160 to rotate (in opposite directions) and with them the two cam shafts 118, 118. Each cam shaft 118, in turn, rotates one of the two cams 119, 119. Upward motion of the rack 152 rotates the cams in the opposite direction. Because the centers of the cam shafts 118 and the pins 135 are aligned, and because slot 134 is just long enough to allow the grip wedges 74, 74 to achieve their full grip on line 38 when the full length of slot 134 is utilized, the rotation of offset cams 119 always moves the grip body 102 positively down and away relative to the wedge grips 74, 74. This causes the wedging of the wedge grips 74, 74 against the line 38 to be released due to the taper of the seating surfaces 78, 78.

FIG. 10 shows an alternative embodiment of the invention that permits the outer part of the mooring line to be chain while the inner part is wire rope. This embodiment is very similar to the previously described embodiment in that it includes a storage winch 30 mounted below a twin drum traction winch 40 to take up, pay out and carry the line 38 handled by the traction winch 40. The line 38 from the traction winch 40 passes through a positively releaseable wedge grip assembly 100 as previously described on its way t a sheave 39. At the edge of the top of column 16 is located a so-called wildcat 47, a sheave specifically adapted to handle chain. Accordingly, the line 38 changes from wire rope to chain between the sheave 39 and the wildcat 47. The wildcat 47 leads the line 38 to the usual underwater fairlead 42, that is also adapted to handle chain.

In the embodiment of FIG. 10, the invention functions in much the same manner as in other embodiments, except that when the chain portion of the line 38 reaches the sheave 39, it is not drawn in further by winch 40. If the chain portion of the line 38 must be drawn in, it is lifted in by power supplied to sheave 47 and permitted to accumulate in the chain locker 26 located below the sheave 47.

Use and Operation

To make use of the apparatus of the invention as disclosed in FIGS. 1 through 9, the semi-submersible oil exploration and drilling platform or rig 10 can be towed into position for use with all of the pontoons 12 evacuated, thus supporting the rig 10 with the pontoons 12 substantially at the surface of the water. The pontoons 12 can then be flooded sufficiently to support the rig 10 at somewhat below the desired final deck elevation with respect to the surface of the sea or other body of water. In other words, it is at or somewhat below the position as illustrated in FIG. 1.

With mooring line 38 extending from one of the storage winches 30, over and around the twin drums of traction winch 40, down through a gripper assembly 100 and through fairlead means 42, an anchor 84 is attached to the outermost end of the mooring line. The anchor is offloaded onto a tug or other appropriate tender vessel 86. Both pairs of cylinders 82, 82 of the gripper assembly 100 are activated to move the grip wedges 74, 74 out of contact with the mooring line 38; the brake 36 on storage winch 30, and the brake (not shown) on the traction winch 40 are also released. The tender vessel or tender 86 hauls out the anchor 84 and mooring line 38 to position the anchor 84 substantially directly over where it is going to be needed to combine with the other seven anchors and mooring lines to position the drilling platform or rig 10 in its desired location while it is being used for its intended purpose. An anchor trip line or buoy line 92 will be attached to the anchor 84 and the anchor 84 will then be lowered to the sea bottom 88, and a buoy 90 attached to the anchor line to identify the anchor location. This process is repeated seven more times until all eight anchors are in their working positions.

The anchors 84 can then be set, one pair at a time. The anchors 84 making up each pair are those which are connected to mooring lines 38 in direct opposition to each other. For example, the anchors 84 and 84 as seen in the left and right lower corners of FIG. 1 will be set at the same time so that the net effect on the positioning of the rig 10 will be negligible.

Setting of each pair of anchors 84 is accomplished by engaging the clutch of each of the traction winches 40 and driving the winch in a direction to wind in on mooring line 38 at high speed and low torque until the slack is out of each of the mooring lines 38. Storage winch 30 accumulates the line 38 as it is drawn in and aids its corresponding traction winch 40 by maintaining a tension of approximately 10 to 15 percent of the tension provided by the traction winch 40. Next, the winches 40 can be operated at slow speed/high torque to approach the tension desired in the load lines 38. This tension is usually less than the breaking strength of a line 38, typically 50 to 60 percent of such breaking strength. Storage winch 30 is again operated in a cooperative manner to maintain a tensile force of approximately 10 to 15 percent of the tensile force applied at the traction winch 40 and to accumulate the line 38. While mooring requirements can vary substantially, in a typical mooring situation a basic mooring line tension of approximately 150,000 lbs. might be pulled by each traction winch 40. The winch 40 would probably be capable of a stall pull of about 750,000 lbs., which would be approximately two-thirds of the breaking strength of the line. The storage winch 30 would thus need to pull up to about 15,000 to 22,500 lbs.

To hold the line 38 after the desired mooring tension is obtained, the cylinders 82, 82 of the gripper assemblies 100 will be activated to cause the corresponding grip wedges 74, 74 to firmly and positively grip the mooring lines 38. The cylinders 82, 82 will be powered to tend to move their rods out of their cylinders, thus providing the maximum holding or wedging action on the grip wedges 74, 74. The rig 10 becomes permanently moored in its precise position with the surface winds and wave action having a minimum effect.

Using the positively releasable gripper means of the inventive apparatus, the mooring system is capable of holding the mooring lines 38 under any applied force on those lines 38 up to the breaking point of the lines themselves. Should more or less tension be desired on the mooring lines 38 for any reason, once the lines are set in position as described above, this tension can be achieved by evacuating more of the water from the pontoons 12 or by introducing more water into those pontoons. If an emergency situation arises, one or more positive release mechanisms 150 associated with a wedge grip assembly 100 can be actuated via its hydraulic cylinder 154. By rotation of the cam shafts 118 and cams 119, the grip body 02 with its seating surfaces, 78, 78 is positively driven beyond the travel limit of the grip wedges 74, 74 restrained by their respective wedge links 132. This causes the grip wedges 74, 74 to be relieved of their wedging force and rope friction and permits them to retract from the line 38. The line 38 is quickly released to run out as needed.

The invention is particularly well suited for retrofit applications where an improved mooring system is needed that is capable of holding a platform or vessel 10 with mooring forces exceeding those in the original design. If the original design of a platform or vessel 10 includes single drum winches capable of pulling only with a force that is less than the breaking strength of a mooring line 38 and having winch braking systems that also hold up to a force less than the breaking strength, then the introduction of a positively releasable wedge grip assembly 100 in accordance with the present invention on each line 38 immediately increases the holding capacity of the mooring system to the full breaking strength of the lines 38. If, at the same time, the lines are upgraded with new lines that have a higher breaking strength without a significant increase in line size or weight, the releasable wedge grip assemblies 100 of the present invention permit an additional margin of improvement with no change in the winches. If, in addition to increased holding force, it is desired to upgrade the mooring system's ability to pull mooring forces, the releasable wedge grip assemblies 100 can be used together with twin drum traction winches and below-deck, associated single drum storage winches as taught herein. These winches replace the conventional single drum winches. Because the traction winches never carry more than the few wraps of line needed for friction they do not lose pulling power as lines are drawn in. Moreover, traction winches are relatively small compared to a single drum winch of conventional design capable of pulling the same force when fully-loaded with line, so the upgrade does not increase deck space used by the mooring system. Whether or not a traction winch based system is used in the retrofit, the presence of the releasable wedge grip assemblies permits all load to be taken off the winches that are "upstream." Without a constant load, this equipment lasts longer and can be more easily serviced, adjusted or replaced.

As will be seen from the above, the present invention involves a mooring apparatus that utilizes wedge grip assemblies equipped with a positive release feature to provide an economical mooring system that will hold to the breaking strength of lines yet can be quickly released by positive actuation means. When the wedge grip assemblies are combined with winch means, particularly twin drum traction winches, the combination is highly advantageous. With a traction winch on deck and a storage winch below deck, the deck-mounted winch means can remain compact and lower torque is required. Due to the positive actuation of the release means the wedge grip assemblies can be mounted either horizontally or vertically or at other desired angles. The increased holding and/or line pulling power available with the present invention means greater safety in storms and more stable mooring in heavy weather, so that fewer work days are lost due to weather disturbances.

It will be clear to a person skilled in the art that the preferred embodiment is but one of the possible ways of making the inventive apparatus. Other embodiments are within the spirit and scope of the invention. For example, other means of actuating the cams in the positive release mechanism (e.g., roller chain, sprockets and cylinder) may be used, and other forms of supporting the release mechanism might be used. While the wedge gripper assembly is shown as having it own frame, it could also be attached directly to available structural members of the platform on which it is used. Accordingly, the invention is not limited to the embodiments described above, but rather is defined in the appended claims.

What is claimed as new and desired to be protected by Letters Patent is:

1. A platform-mounted apparatus for drawing in, holding, paying out and rapidly releasing a flexible load line having the properties of a wire rope comprising:

(a) winch means mounted to said platform, said winch means having the ability to draw in and hold the line up to a tensile force less than the breaking strength of the line; and (b) wedge gripper means for holding said line by self-locking up to a tensile force substantially equal to the breaking strength of the line, said gripper means comprising:

(1) a grip frame mounted to the platform;

(2) a pair of opposed grip wedges, having opposed internal gripping surfaces for engaging the line and external wedging surfaces that taper toward each other in the direction of tensile force in the line, each grip wedge having a wide end and a narrow end;

(3) grip wedge connection means for moveably connecting the side end of each grip wedge to the grip frame, said grip wedge connection means including limiting means for limiting the motioin of said grip wedges relative to said platform at a travel limit in the direction of the tensile force in the line;

(4) a grip body having opposed seating surfaces against which the external wedging surfaces moveably bear, said seating surfaces tapering toward each other at substantially the same angle as the external wedging surfaces such that relative motion of the grip wedges into the taper of the seating surfaces causes the opposed grip wedges to wedge together to engage the line, and relative motion out of the taper of the seating surfaces causes the opposed grip wedges to move apart and deisengage the line;

(5) grip body holding means for connecting the grip body to the grip frame independently of the grip wedges, said grip body holding means permitting the grip body to move relative to the grip frame between a self-locking grip position and a release position; and (6) release means connected to the grip body holding means for positively moving the grip body relative to the grip frame into said release position while said limiting means maintains said grip wedges at said travel limit, whereby the grip body is moved relative to the grip wedges so that the grip wedges move out of the taper of the seating surfaces and release the line from self-locking.

2. The apparatus as recited in claim 1 wherein the release means for positively moving the grip body relative to the grip frame comprises a cam shaft having a cam thereon, said cam being inserted in the grip body holding means such that rotation of the cam shaft and cam causes the grip body to move between its grip position and its release position.

3. The apparatus as recited in claim 1 wherein the grip body holding means comprises:

at least one release link haivng one end connected to the grip body and the other end containing a cam opening for receiving a cam; and at least one cam shaft support having one end connected to the grip frame and the other end containing a shaft opening for receiving a cam shaft; and said release means for positively moving the grip body relative to the grip frame comprises a cam shaft passing through the shaft opening in the cam shaft support and having a cam received in the cam opening in the release link and means for rotating the cam shaft.

4. The apparatus as recited in claim 3 wherein the cam is a circular cam mounted off-center on the cam shaft.

5. The apparatus as recited in claim 1 wherein the winch means comprises traction winch means.

6. The apparatus as recited in claim 5 wherein the traction winch means comprises a pair of winch drums around which the line is wrapped three or more times.

7. The apparatus as recited in claim 5 further comprising a storage winch for drawing in, holding and paying out the line providing back-tension for said traction winch.

8. The apparatus as recited in claim 6 wherein the traction winch means further comprises a center pinion drive means to drive both winch drums.

9. A platform-mounted apparatus for drawing in, holding, paying out and rapidly releasing a flexible load line having the properties of a wire rope comprising:

(a) winch means mounted to said platform, said winch means having the ability to draw in and hold the line up to a tensile force less than the breaking strength of the line; and (b) wedge gripper means for holding said line by self-locking up to a tensile force substantially equal to the breaking strength of the line, said gripper means mounted to said platform and comprising:

(1) a pair of opposed grip wedges having opposed internal gripping surfaces for engaging the line and external wedging surfaces that taper toward each other in the direction of tensile force in the line;

(2) of grip body having opposed seating surfaces against which the external wedging surfaces moveably bear, said seating surfaces tapering toward each other at substantially the same angle as the external wedging surfaces, said grip body and said grip wedges being relatively shiftable between a line engaging position wherein said grip wedges are received within the taper of the seating surfaces such that the opposed grip wedges are wedged together to engage the line for self-locking, and a line clearing position wherein said grip wedges move out of the taper of the seating surfaces such that the opposed grip wedges are moveable apart to disengage the line; and (3) line release means operably connecting said grip body and said grip wedges to said platform for positively moving the grip body relative to the grip wedges to release self-locking by moving the grip body into said line clearing position while said grip wedges are limited in their travel relative to said platform.

10. The apparatus as recited in claim 9 wherein the line release means comprises:

a grip frame mounted to the platform;

grip wedge connection means for moveably connecting each grip wedge to the grip frame and defining a travel limit for each grip wedge in the direction of tensile force in the line;

grip body holding means for connecting the grip body to the grip frame, said grip body holding means permitting the grip body to move relative to the grip frame between a grip position corresponding to said line engaging position and a release position corresponding to said line clearing position; and a cam shaft having a cam thereon, said cam being inserted in the grip body holding means such that rotation of the cam shaft and cam causes the grip body to move between its grip position and its release position.

11. The apparatus as recited in claim 9 wherein the release means comprises:

at least one release link having one end connected to the grip body and the other end containing a cam opening for receiving a cam;

at least one cam shaft support having one end connected to the platform and the other end containing a shaft opening for receiving a cam shaft;

a cam shaft passing through the shaft opening in the cam shaft support and having a cam received in the cam opening in the release link; and means for rotating the cam shaft.

12. The apparatus as recited in claim 11 wherein the cam is a circular cam mounted off-center on the cam shaft.

13. The apparatus as recited in claim 9 wherein the winch means comprises traction winch means.

14. The apparatus as recited in claim 13 wherein the traction winch means comprises a pair of winch drums around which the line is wrapped three or more times.

15. The apparatus as recited in claim 13 further comprising a storage winch for drawing in, holding and paying out the line and providing back-tension for said traction winch.

16. The apparatus as recited in claim 14 wherein the traction winch means further comprises a center pinion drive means to drive both winch drums.

17. A platform-mounted apparatus for holding a flexible load line having the properties of a wire rope by self-locking up to a tensile force substantially equal to the breaking strength of the line and for rapidly releasing said line comprising:

(1) a pair of opposed grip wedges having opposed internal gripping surfaces for engaging the line and external wedging surfaces that taper toward each other in the direction of tensile force in the line;

(2) a grip body having opposed seating surfaces against which the external wedging surfaces moveably bear, said seating surfaces tapering toward each other at substantially the same angle as the external wedging surfaces, said grip body and said grip wedges being relatively shiftable between a line engaging position wherein said grip wedges are received within the taper of the seating surfaces such that the opposed grip wedges are wedged together to engage the line for self-locking, and a line clearing position wherein said grip wedges move out of the taper of the seating surfaces such that the opposed grip wedges are moveable apart to disengage the line; and (3) line release means operably connecting said grip body and said grip wedges to said platform for positively moving the grip body relative to the grip wedges to release self-locking, by moving the grip body into said line clearing position while said grip wedges are limited in their travel relative to said platform.

18. The apparatus as recited in claim 17 wherein the line release means comprises:

a grip frame mounted to the platform;

grip wedge connection means for moveably connecting each grip wedge to the grip frame, said grip connection means defining a travel limit for each grip wedge in the direction of the tensile force in the line;

grip body holding means connecting the grip body to the grip frame, said grip body holding means permitting the grip body to move relative to the grip frame between a grip position corresponding to said line engaging position and a release position corresponding to said line clearing position; and a cam shaft having a cam thereon, said cam being inserted in the grip body holding means such that rotation of the cam shaft and cam causes the grip body to move between its grip position and release position.

19. The apparatus as recited in claim 17 wherein the release means comprises:

at least one release link having one end connected to the grip body and the other end containing a cam opening for receiving a cam;

at least one cam shaft support having one end connected to the grip frame and the other end containing a shaft opening for receiving a cam shaft;

a cam shaft passing through the shaft opening in the cam shaft support and having a cam received in the cam opening in the release link; and means for rotating the cam shaft.

20. The apparatus as recited in claim 19 wherein the cam is a circular cam mounted off-center on the cam shaft.

21. The apparatus as recited in claim 17 wherein the winch means comprises traction winch means.

22. The apparatus as recited in claim 21 wherein the traction winch means comprises a pair of winch drums around which the line is wrapped three or more times.

23. The apparatus as recited in claim 22 further comprising a storage winch for drawing in, holding and paying out the line and providing a back-tension for said traction winch.

24. The apparatus as recited in claim 22 wherein the traction winch means further comprises a center pinion drive means to drive both winch drums.

* * * * *